United States Patent [19]

Bearce

[11] 4,014,106

[45] Mar. 29, 1977

[54] DRYER

[76] Inventor: Wendell E. Bearce, Box 241, St. Clairsville, Ohio 43950

[22] Filed: June 20, 1975

[21] Appl. No.: 588,673

[52] U.S. Cl. ..... 34/142; 165/88; 165/89; 165/90; 432/107

[51] Int. Cl.[2] ..... F26B 11/04

[58] Field of Search ..... 432/112, 107, 114; 165/89, 90, 88; 34/140, 141, 142; 110/14

[56] References Cited

UNITED STATES PATENTS

| | | | |
|---|---|---|---|
| 1,487,248 | 3/1924 | Lantz | 165/89 |
| 1,728,495 | 9/1929 | Lindhard | 165/90 X |
| 1,748,178 | 2/1930 | Hume | 34/141 |
| 2,265,358 | 12/1941 | Denning | 432/112 |
| 2,872,386 | 2/1959 | Aspegren | 165/88 X |
| 3,288,452 | 11/1966 | Stewart | 432/112 X |
| 3,401,923 | 9/1968 | Bearce | 34/48 X |

*Primary Examiner*—William F. O'Dea
*Assistant Examiner*—Harold Joyce
*Attorney, Agent, or Firm*—William J. Ruano

[57] ABSTRACT

A dryer for removing moisture from wet fine particles, such as coal, comprising an insulated stationary cylinder in which an open-ended metallic cylindrical tube is rotated, coaxially in an essentially horizontal position. Wet particles are introduced in said open end while hot air is circulated between the stationary cylinder and the tube. Metallic balls or the like contained in the rotating tube are interspersed in the wet mix. Perforated fins and baffles extend from the outer wall of the tube to aid in transferring heat, by conduction, to the tube and metallic balls to evaporate the moisture before the coal is discharged at the opposite end through a screen section of the tube. Additives may be introduced into the wet mix to coat the dried coal particles to prevent dust or prepare the mix for pelletizing or briquetting.

2 Claims, 3 Drawing Figures

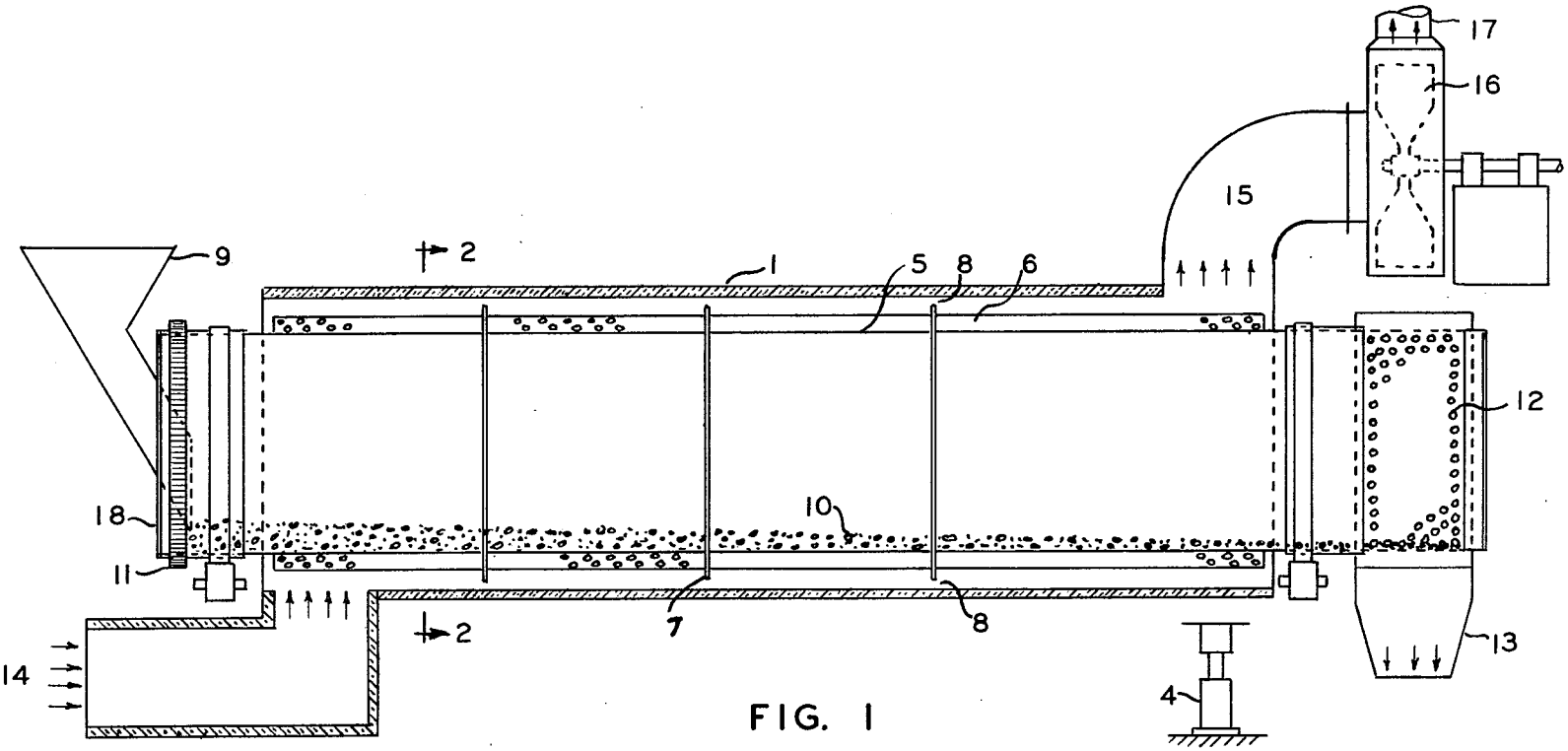
FIG. 1
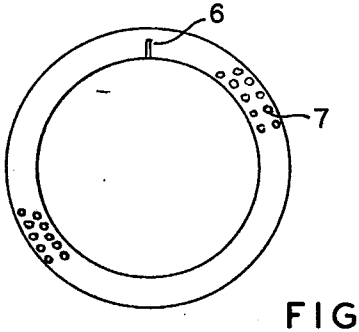
FIG. 3
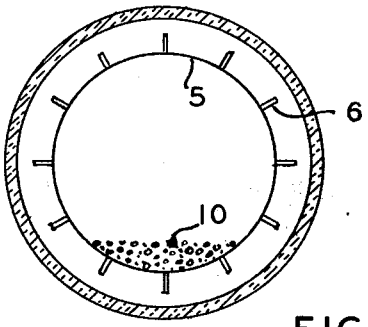
FIG. 2
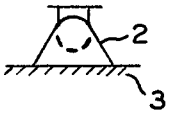

DRYER

This invention is an improvement over that described in my prior U.S. Pat. No. 3,401,923, dated Sept. 17, 1968, for a Dryer.

While the dryer described in my aforesaid earlier patent is highly efficient, it has the drawback of embodying somewhat numerous parts, which add significantly to the cost of manufacture, as well as to the cost of maintenance of the dryer.

An object of my present invention is to provide a novel dryer which has relatively few, simple and inexpensive parts, as compared to those of my prior dryer, and yet which is highly efficient in drying wet coal particles and the like.

Another object of my invention is to provide a dryer for wet coal or other particles, which dryer will avoid any danger of forming dust, which under certain circumstances may cause an explosion, as well as being injurious to the health of workmen.

Other objects and advantages will become more apparent from the study of the following description taken with the accompanying drawing wherein:

FIG. 1 is a longitudinal, vertical cross-sectional view of a dryer embodying the principles of the present invention and which is particularly useful for drying wet coal;

FIG. 2 is a transverse, cross-sectional view taken along line 2—2 of FIG. 1; and FIG. 3 is an end view showing the annular baffle 7 of FIG. 1.

Referring more particularly to FIGS. 1, 2 and 3 of the drawing, numeral 1 denotes an insulated, stationary shell of substantially cylindrical construction, which is pivotally mounted, at one lower end, to a pivot 2 mounted on a floor 3 or other stationary support. At the other end, a jack 4 is mounted which is adapted to selectively lift or lower the shell 1 about its pivot 2 as a center if it is to be adjusted to other than the normal horizontal position of shell 1.

Interiorly and coaxially of the shell 1 is a rotatably mounted, hollow metal cylinder or tube 5. A plurality of perforated heat transferring fins 6 are integrally welded or otherwise rigidly secured to the outer surface of tube 5, as shown more clearly in FIG. 2, and extend throughout the entire length of tube 5. At longitudinally spaced points of tube 5, there are provided perforated annular baffles 7, shown more clearly in FIG. 3. The purpose of fins 6 and baffles 7 is to effectively transfer heat, by conduction, from the outer side of tube 5 to the inner side thereof, to heat the wet particle mixture fed therein. A gap 8 is provided between the outer periphery of each baffle 7 and the interior surface of shell 1.

The wet mixture of coal particles is fed into a hopper 9, thence through a large central opening of an end ring 18 and into the interior of cylinder 5. The wet mixture is in the form of a gradually tapering layer which includes a plurality of small metal balls, or possibly other heat transferring particles of other shapes, preferably but not necessarily of metal. However aluminum oxide is a suitable material for such particles because of its high heat carrying capacity. The purpose of such metallic balls or other shaped particles is to transfer the heat from cylinder 5 to the wet coal particles and prevent a build-up of wet steely particles on the inner surface of the tube.

The tube 5 is rotated about its axis by a driving means, including a gear 11, powered by a suitable motor or the like (not shown).

At the right of tube 5, as viewed in FIG. 1, there is provided a cylindrical screen section 12 for screening coal particles, after they have been dried, thus separating them from the metallic balls, after which they are discharged through the outlet chute 13.

Hot air 14 generated from any suitable heating source is introduced into the space between tube 5 and shell 1 and thereafter discharged through elbow 15 and exhausted, by a fan 16, through an exhaust pipe 17.

In operation, as the wet coal is fed through hopper 9 into tube 5 and mixed with the balls 10 or other heated particles, and as the tube 5 is rotated about its axis, a layer of wet coal particles and such balls will remain at the bottom of the tube and will gradually taper off, in depth, from the left to the right of tube 5, as viewed in FIG. 1, as a consequence of the continual feed by hopper 9. By the time the mix moves into the screen section 12, it will be dry, therefore, it can be suitably screened from balls 10.

In order to prevent excessive dust, this can be done either by lowering jack 4 to lower the right end of tube 5, therefore speeding up the drying process, conversely, if the coal is too wet, jack 4 may be lifted to slow down the rate of movement longitudinally of tube 5 so as to become heated to a greater extent. A more effective way to prevent the creation of dust as the result of the drying process is to introduce, in hopper 9, with the wet mix of coal particles, a suitable oily material, such as petroleum or other coal derivative which is not volatile at 212° F., the boiling point of water, so as to provide an oily coating to the dried coal particles after the water has been evaporated. As the result of the thorough mixing provided by the tumbling and rolling action of the heated particles of coal in the tube 5, a very thorough drying and coating of oil-like material is provided. A relatively small quantity of such oil-like material is sufficient to make the coal particles free of dust.

While the dryer has been described as being useful for drying coal particles, it may be used for drying other types of particles as well as coating them with an oil-like film to prevent excess formation of dust or with suitable additives in preparation for pelletizing or briquetting.

Thus it will be seen that I have provided a highly efficient, yet extremely inexpensive dryer made up of relatively few parts and requiring very little maintenance, providing a high degree of heat transfer from the heated air source to the interior of the rotating tube without the necessity of a feeding screw inside the tube or scoops or flap gates, as required in my prior patent, which cannot be made completely air tight; furthermore, I have provided a dryer construction having no contact between the coal and the hot gases for heating it and wherein no power is required for lifting the balls, as required in my prior patent, with the attendant noise from dropping of the balls, and whereby seals between movable and stationary parts are eliminated.

While I have illustrated and described a single specific embodiment of my invention, it will be understood that this is by way of illustration only and that various changes and modifications may be contemplated in my invention and within the scope of the following claims.

I claim:

1. A dryer for drying wet coal particles and the like, comprising a stationary, insulating, substantially cylindrical shell, a cylindrical metallic tube coaxially mounted within said shell in spaced relationship therewith, means for feeding the wet coal particles through a relatively large opening in one end of said tube, means for rotating said tube about its axis, thereby distributing wet coal particles throughout the entire length of said tube, a cylindrical screen mounted on the other end of said tube, an outlet chute immediately below said screen, means for circulating hot air longitudinally through the space between said tube and shell including an exhaust fan, a plurality of radially outwardly extending fins integrally secured along spaced outer portions of said tube for more effectively transferring heat from the exterior to the interior surface of said tube, certain of said fins extending longitudinally throughout the entire length of said tube and being perforated throughout their length, and a plurality of metallic balls in said tube mixed with said particles whereby after said coal particles are dried, they are rotated in said screen and discharged by gravity through said outlet chute and screened from said balls.

2. Apparatus as recited in claim 1 wherein others of said fins comprise a plurality of perforated annular baffles longitudinally spaced along said tube.

* * * * *